US006341711B1

(12) United States Patent
Blake

(10) Patent No.: US 6,341,711 B1
(45) **Date of Patent: *Jan. 29, 2002**

(54) VALVE MOUNTING ASSEMBLY FOR AEROSOL CONTAINER AND METHOD

(75) Inventor: Robert R. Blake, Morelos (MX)

(73) Assignee: Precision Valve Corporation, Yonkers, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/869,382

(22) Filed: Jun. 5, 1997

Related U.S. Application Data

(63) Continuation of application No. 08/713,587, filed on Sep. 13, 1996, now abandoned, which is a continuation of application No. 08/384,736, filed on Feb. 3, 1995, now abandoned.

(51) Int. Cl.[7] ..... B65D 53/02
(52) U.S. Cl. ..... 220/614; 220/378; 220/803
(58) Field of Search ..... 220/614, 681, 220/378, 358, 357, 803, 804

(56) References Cited

U.S. PATENT DOCUMENTS

| | | | | | |
|---|---|---|---|---|---|
| 2,994,455 | A | * | 8/1961 | Arnold | 220/681 |
| 3,064,853 | A | * | 11/1962 | Lents et al. | 220/358 |
| 3,273,743 | A | * | 9/1966 | McColl | 220/378 |
| 3,342,381 | A | * | 9/1967 | Simons et al. | 220/614 |
| 3,417,177 | A | * | 12/1968 | Simons et al. | |
| 3,443,006 | A | * | 5/1969 | Simons et al. | |
| 4,347,947 | A | * | 9/1982 | Hammes | 220/378 |
| 4,546,525 | A | * | 10/1985 | Abplanalp | 29/33 K |
| 4,547,948 | A | * | 10/1985 | Abplanalp | 29/417 |
| 4,621,964 | A | * | 11/1986 | Ratke et al. | 220/614 |
| 5,213,231 | A | * | 5/1993 | Abplanalp et al. | 220/614 |
| 5,215,209 | A | * | 6/1993 | Ratke | 220/614 |
| 5,325,985 | A | * | 7/1994 | Ratke | 220/614 |
| 5,579,944 | A | * | 12/1996 | Hafner et al. | 220/310.1 |

FOREIGN PATENT DOCUMENTS

| | | | | |
|---|---|---|---|---|
| EP | 0033626 | * | 8/1981 | 220/614 |
| EP | 33626 | * | 8/1981 | 220/614 |

* cited by examiner

*Primary Examiner*—Stephen Castellano
(74) *Attorney, Agent, or Firm*—Kilgannon & Steidl

(57) ABSTRACT

A valve mounting assembly for an aerosol container comprising a mounting cup and a sleeve gasket initially positioned on at least a substantial portion of the skirt of the mounting cup. The sleeve gasket has an axial height and radial thickness of from about 0.080 to 0.150 inches and from about 0.030 to 0.060 inches, respectively; said dimension being preferably from about 0.090 to 0.140 inches and from about 0.035 to 0.055 inches, respectively and said dimensions most preferably being from about 0.100 to 0.130 inches and from about 0.040 to 0.050 inches. In a method herein, the gasket is advanced onto the skirt of the mounting cup, and then advanced into the annular channel of the mounting cup and deformed about 90° to form a gasket of dimensions equivalent to a cut gasket. The gasket may be cut from an extruded tube of gasket material, which can be cut to very precise longitudinal dimensions. When the gasket is turned about 90° in the channel of the mounting cup, the gasket is turned into a shape approximately that of a cut gasket and the original axial dimension of the gasket becomes its radial thickness. In this way, a cut gasket shape can be achieved having precise inner and outer dimensions without requiring any milling of the gasket material, as has been previously required with extruded cut gaskets. Also, if desired, the gasket may be heated, or an adhesive may be used, to hold the gasket in the desired shape in the annular channel of the mounting cup.

7 Claims, 6 Drawing Sheets

VALVE MOUNTING ASSEMBLY FOR AEROSOL CONTAINER AND METHOD

This application is a continuation of application Ser. No. 08/713,587 filed on Sep. 13, 1996, now abandoned, which is a continuation of U.S. Ser. No. 08/384,736 filed Feb. 3, 1995, now abandoned.

BACKGROUND OF THE INVENTION

This invention generally relates to valve mounting assemblies for aerosol containers, said mounting assemblies being commonly referred to as "mounting cups". More particularly, this invention relates to a particular tubular gasket (sleeve gasket) for the mounting cup, which varies dimensionally from prior sleeve gasketed mounting cups. Further, during a certain interval of the positioning of the sleeve gasket onto the mounting cup, the sleeve gasket varies in its spatial relationship with the mounting cup as compared to prior sleeve gaskets.

Aerosol containers are widely used to package a variety of fluid materials, both liquid and powdered particulate products. Typically, the product and a propellant are confined within the container, at above atmospheric pressure, and the product is released from the container by manually opening a dispensing valve to cause the pressure within the container to deliver the product through the valve and connecting conduits to a discharge orifice.

The dispensing valve is normally mounted in a container opening via a mounting assembly that includes a mounting cup and sealing gasket. More particularly, the container includes a top opening or bead portion. The mounting cup includes a central pedestal portion for clinching the dispensing valve, a skirt portion extending from the pedestal portion, which skirt portion merges into a radially outwardly extending channel portion, the channel portion being configured to receive the rounded bead portion of the container opening. The sealing gasket normally extends along a part of the skirt portion and to a limited degree into the channel portion. After the sealing gasket is disposed onto the mounting cup, the cup is positioned onto the container and the cup is clinched to the container. The clinching operation is well-known to those skilled in the aerosol container art.

Obviously, for an aerosol container, the seal between the mounting cup and the container bead is critical. This seal is accomplished through the sealing gasket, which must prevent the loss of pressure and loss of container contents through the interface between the container bead and mounting cup.

Various types of sealing gaskets are known in the art. One common type of gasket comprises a conventional flat rubber gasket that is placed inside the channel of the mounting cup. Gaskets of this type are typically manufactured by extruding and vulcanizing the compounded rubber mixture onto metal rods and then cutting or slicing off thin, annular sections of the extruded and vulcanized product (tube). These gaskets are often referred to as cut or flat gaskets. Cut gaskets are relatively expensive to manufacture. It is very difficult to control precisely the radial dimensions of the tubes, from which the cut gaskets are made, the tubes having varying dimensions and being out of round. Consequently, the inner and outer cylindrical surfaces of these tubes are usually laser cut to the desired dimensions, said cutting adding considerable cost to the gasket manufacture.

Another type of gasket comprises a relatively thin sleeve of elastomeric material that is mounted on the skirt portion of the mounting cup and then advanced along said skirt so that the gasket extends ultimately into a limited portion of the annular channel of the mounting cup. When the mounting cup is mounted and then clinched onto the aerosol container, the sealing gasket is forced into a sealing engagement with both the channel of the mounting cup and the bead of the container. Typically, these gaskets are forced into a sealing engagement with the mounting cup along only a relatively small circumferential portion of the gasket at positions referred to as the 5 o'clock and 11 o'clock positions. Due to their shape, gaskets of this type are often referred to as sleeve gaskets.

Sleeve gaskets are manufactured by advancing a tube of gasket material onto the skirt of the mounting cup and then cutting or slicing off annular sections of the tube. The axial heights of sleeve gaskets, however, are substantially greater than the axial heights of cut gasket. Sleeve gaskets are much less expensive to make and assemble to the mounting cup than cut gaskets. When making sleeve gaskets, it is not necessary to mill the inside and outside cylindrical surfaces of the extruded tubes of gasket material. Moreover, a tubular sleeve gasket may be assembled to the mounting cup more easily than assembling a cut gasket to the mounting cup.

The sealing gasket may also be formed by a liquid material containing water or solvent that is deposited in the annular channel of the mounting cup. The solvent or water evaporates during curing and the remaining material produces a resilient sealing material in the mounting cup channel. Forming the gasket from a liquid solvent also is a comparatively expensive procedure requiring multiple production steps including the use of curing ovens or other means to dry and cure the gasket material. Moreover, means must be provided for rotating the mounting cup beneath and relative to a metering apparatus that dispenses carefully determined amounts of a gasket forming composition. These gaskets are commonly referred to as "flowed-in" gaskets.

Thus, the above described types of gaskets, as well as others that may be used, have both advantages and disadvantages. Both cut and sleeve gaskets generally produce excellent results. Cut gaskets have seen widespread commercial use for a longer period of time than sleeve gaskets. To use sleeve gaskets on equipment previously used with flat or cut gaskets requires an adjustment in the crimping and filling tools. Often, a crimping line will be required to accommodate both flat and sleeve gaskets; depending on the gasket specifications of the valved container being crimped. To avoid having to make the crimping and filling change or adjustment, there has been a tendency, particularly in Europe, to stay with flat or cut gaskets, even though such gaskets are more costly.

SUMMARY OF THE INVENTION

An object of this invention is to provide an improved gasketed mounting cup for aerosol containers and an improved method for assembling the gasket to the mounting cup.

Another object of the present invention is to provide a mounting cup for an aerosol container with a sealing gasket that has the cost advantages of a sleeve gasket but that allows the crimping and filling equipment to be used at the same settings for the clinching and filling of a cut gasket.

A further object of this invention is to position a sleeve gasket on a mounting cup so that the gasket has dimensions equivalent to a flat or cut gasket without requiring any milling of the gasket material.

Another object of this invention is to provide a novel sleeve gasket disposed on a substantial portion of the skirt of the mounting cup such that during the affixment of the mounting cup and container, the sleeve gasket may be advanced into the channel portion of the mounting cup.

These and other objectives are attained with a valve mounting assembly for an aerosol container comprising a mounting cup and a relatively thick sleeve gasket of limited height positioned on the mounting cup.

The sleeve gasket of this invention is positioned onto the skirt portion of the mounting cup and then ultimately advanced into the annular channel of the mounting cup prior to clinching the mounting cup and container. The advancing of the sleeve gasket of this invention prior to the clinching operation results in a deformation of the gasket of about 90° to form a gasket comparable in shape and dimension to a conventional cut gasket. The sleeve gasket of this invention may be cut from an extruded tube of gasket material, which can be cut to very precise longitudinal dimensions. When the sleeve gasket is turned about 90° into the channel of the mounting cup, the original axial dimension of the gasket becomes its radial dimension or thickness. In this way, a cut gasket shape can be achieved having precise inner and outer dimensions without requiring the costly processing of the gasket material, as has been previously required with prior art cut gaskets.

The sleeve gasket may be advanced onto the skirt of the mounting cup and then advanced into the annular channel thereof in one operation but preferably it is done in two separate steps. For instance, the sleeve gasket may be advanced onto the skirt of the mounting cup at one location and sold in this condition to a manufacturer of filled aerosol containers, who then advances and deforms the gasket into the desired shape in the annular channel of the mounting cup.

Where the sleeve gasket is disposed on the skirt portion, or at least a substantial portion of the sleeve gasket is disposed on the skirt of the mounting cup and transferred in this form to another location, there is the advantage that the friction fit between the skirt of the mounting cup and the sleeve gasket is adequate to prevent dislodgement of the gasket from the mounting cup during transport and storage prior to the clinching of the gasketed mounting cup and the container, a problem often present in the transportation and storage of cut gaskets.

Where, however, it is desired to dispose the sleeve gasket of this invention normal to the axial length of the skirt of the mounting cup, means or steps may be used to maintain or to hold the gasket in the deformed shape in the channel of the mounting cup. Any suitable means may be used to advance and deform the gasket into the desired shape in the mounting cup channel and to maintain the gasket in the channel. For example, the aerosol container itself may be used to do this as the mounting cup is disposed onto the filled container or adhesive may be used to bond the deformed gasket to the channel of the mounting cup.

Further benefits and advantages of the invention will become apparent from a consideration of the following detailed description given with reference to the accompanying drawings which specify and show preferred embodiment of the invention.

DETAILED DESCRIPTION OF THE PREFERRED EMBODIMENTS

Figure 1:
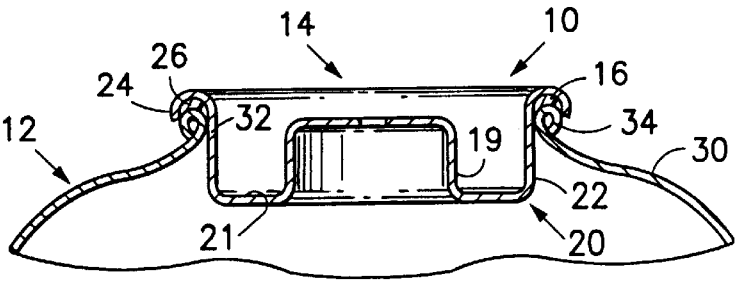
FIG. 1 is a cross sectional view of a valve mounting assembly of this invention positioned on an aerosol container immediately prior to clinching.

FIG. 1 illustrates a valve mounting assembly, generally shown at 10, positioned within the open end of a container 12 (partially shown). More specifically, assembly 10 includes mounting cup 14 and gasket 16, and the mounting cup, in turn, includes a central body 20 having a pedestal portion 19, a profile portion 21, and a skirt portion 22 terminating in a radially outwardly rolled flange 24 that forms annular gasket receiving channel 26. Container 12 includes upper portion 30 that forms central container opening 32 and an upper rolled rim or bead 34 that extends around opening 32. As shown in FIG. 1, channel 26 of cup 14 is mounted on and receives bead 34. Gasket 16 is disposed between bead 34 and the under surface of channel 26. The bead 34 directly supports the valve mounting assembly 10.

Figure 2:
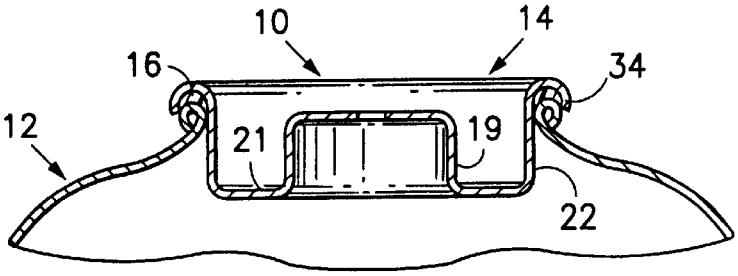
FIG. 2 shows the mounting cup assembly and aerosol container of FIG. 1 clinched together.

With reference to FIG. 2, in order to connect assembly 10 permanently to container 12, a portion of the skirt 22 is forced outward, underneath bead 34, around the circumference of skirt 22, thereby clinching mounting assembly 10 to container 12. This clinching operation also forces gasket 16 into a tight pressure fit against both bead 34 and the under-surface of channel 26, thereby forming an effective seal therebetween.

Figure 3:
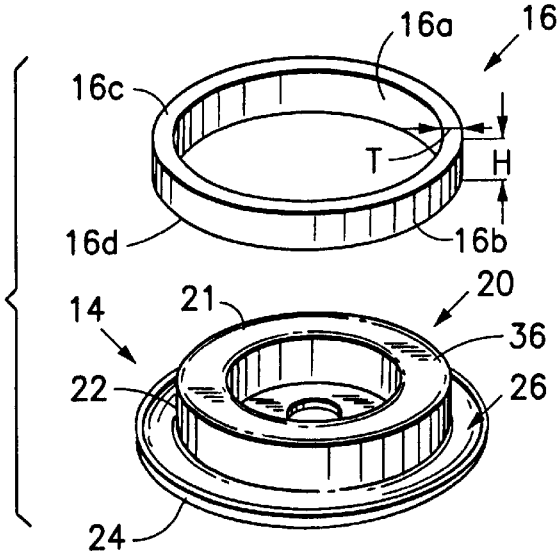
FIG. 3 is an inverted, enlarged, exploded perspective view of the mounting cup and sealing gasket of the valve mounting assembly of FIG. 1.
Figure 4:
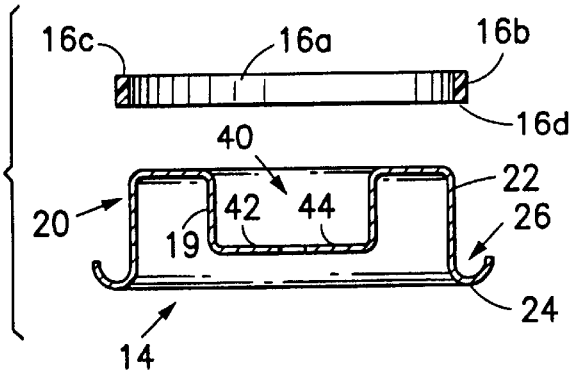
FIG. 4 is an inverted, enlarged, exploded cross sectional view of the mounting cup and sealing gasket.

In accordance with the present invention, gasket 16 is formed from a sleeve shaped gasket that is mounted on the skirt 22 of cup 14 and then by advancing the gasket into the channel portion of the mounting cup deformed 90° into a shape approximating that of a flat gasket. FIGS. 3 and 4 are an exploded view of mounting cup 14 and sleeve gasket 16.

As previously mentioned, mounting cup 14 includes a skirt 22 and a radially outwardly rolled flange 24 that forms channel 26. More specifically, skirt 22 of cylindrical body 20 is integral with and extends from the profile portion 21 and flange 24 extends integrally from the skirt 22. A pedestal portion 19 is centrally disposed within profile 21, and receives the manual valve (not shown) including a valve stem (not shown) that extends through aperture 44.

Mounting cups of the type described above are well known in the art, and cup 14 may be made in any appropriate procedure and from any suitable material. For instance, cup 14 may be made of metal such as steel, aluminum, and like and formed into the desired shape through a stamping process.

With the above construction of mounting cup 14, it is important that a pressure resistant seal be formed between the cup 14 and container 12, and more particularly, between the rolled rim on bead 34 of the container and the channel 26 formed by the rolled flange 24. Gasket 16 is provided to form this seal.

As shown in FIGS. 3 and 4, gasket 16 includes concentric inner and outer cylindrical surfaces 16*a* and 16*b* and top and bottom edges 16*c* and 16*d,* and preferably, the gasket has a uniform height and a uniform thickness. The height and thickness of the gasket 16 are shown in FIG. 3 as the dimension "H" and "T", respectively. Gasket 16 thus has a sleeve shape, but is of less height and substantially thicker than conventional sleeve gaskets. Preferably, the height ("H") and thickness ("T") of gasket 16 are equal or equivalent to the radial thickness and height, respectively, of conventional flat or cut aerosol gaskets. Hence, for instance, the height of gasket 16 may be between 0.080 and 0.150 inches and the thickness of the gasket may be from 0.030 to 0.060 inches. As more specific examples, gasket 16 may have a preferable height of approximately 0.090 to 0.140 inches and most preferably from 0.100 to 0.130 inches, and a preferable thickness of approximately 0.035 to 0.055 inches and most preferably between 0.040 to 0.050 inches.

In addition, the inside diameter 16*a* of gasket 16 preferably is substantially equal to or preferably slightly less than the outside diameter of the skirt 22 of mounting cup 14. As an example, the outside diameter of cylindrical skirt 22 will normally be approximately 0.990 inches, and thus the inner diameter of gasket 16 is substantially equal to or preferably slightly less than 0.990 inches. Gasket 16 may be made of any suitable material presently used for cut gaskets such as natural or synthetic rubbers, elastomers, polymers and mixtures thereof capable of deforming in the manner described below.

Figure 5:
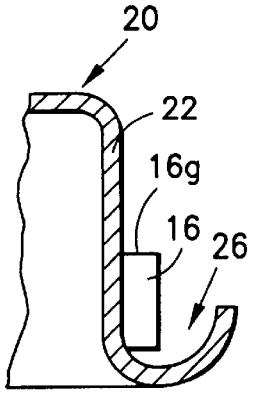
FIG. 5 is an enlarged schematic view of a portion of the mounting cup, showing the sealing gasket in an initially mounted position.
Figure 6:
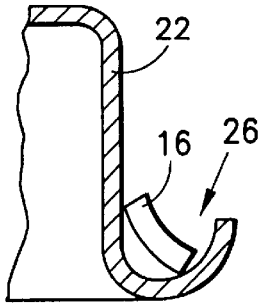
FIG. 6 is a schematic view, similar to FIG. 5, but showing the sealing gasket partially advanced into the channel portion of the mounting cup.
Figure 11:
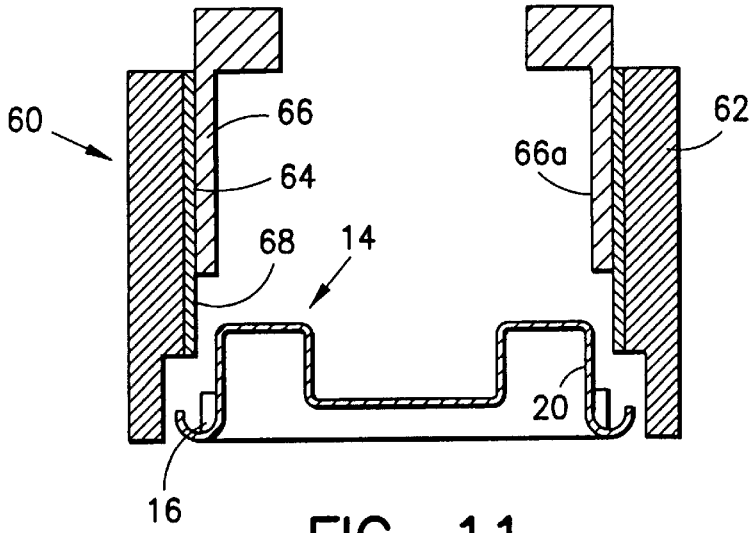
FIG. 11 is a cross sectional schematic view of an apparatus for positioning the gasket on the mounting cup.

To form gasket 16 into the desired shape, the gasket may be mounted on skirt 22 of cylindrical body 20 of cup 14, as shown in FIG. 5. Then, having reference to FIGS. 6 and 7, the gasket is advanced along the skirt 22 into the mounting cup channel 26. The advance may be accomplished by advancing the gasketed mounting cup of FIG. 5 against the bead 34 of container 12 (shown in FIG. 1), and specifically by contacting edge 16*g* of the gasket with the container rim and urging the gasket into the channel 26 as the valve assembly is placed on the container rim for filling. Alternatively, a device such as shown in FIG. 11 may be employed.

Figure 7:
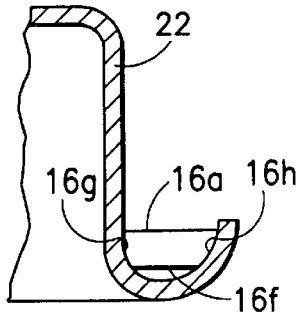
FIG. 7 is also a schematic view, similar to FIGS. 5 and 6, but showing the sealing gasket after it has been fully advanced into the channel of the mounting cup but prior to contacting the mounting cup and the bead of the container.

As gasket 16 is advanced along skirt 22, flange 24 forces and guides the lower portion of gasket 16 radially outward, away from skirt 22. Gasket 16 is advanced along skirt 22 until the gasket is deformed 90° into the shape approximating a flat gasket, as shown in FIG. 7, in which the gasket has upper and lower surfaces 16*e* and 16*f* and concentric inner and outer circular edges 16*g,* 16*h*.As gasket 16 is deformed into the position and shape shown in FIG. 7, the height of the gasket becomes its radial thickness between its inside and outside circumferential edges, and the original radial thickness of the gasket becomes its axial thickness or height. Hence, in the position and shape shown in FIG. 7, gasket 16 has a width of about 0.100 to 0.130 inches and an axial thickness of about 0.030 to 0.060 inches.

Figure 8:
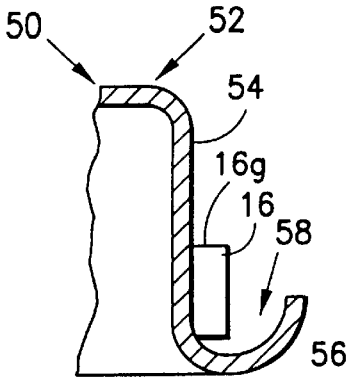
FIGS. 8, 9, and 10 are schematic views similar to FIGS. 5, 6, and 7 respectively, and show the sealing gasket mounted and positioned on an alternate type of mounting cup.
Figure 10:
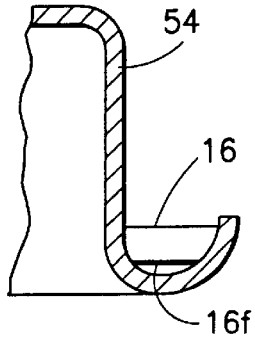

As shown in FIGS. 5 and 8, the sleeve gasket 16 is disposed to a substantial extent on the skirt 22 of the mounting cup 14. There is an advantage in this placement of the sleeve gasket on the mounting cup, namely that in transporting and storing the sleeve gasket in this form, the gasket is better retained on the cup through the interference fit of sleeve gasket and skirt. With cut-gasket mounting cups, it is not unusual to have a bothersome degree of gaskets being dislodged from the cup prior to the container/mounting cup clinching operation.

Where the sleeve gasket is advanced on the mounting cup to the position shown in FIGS. 7 and 10, means may be provided for maintaining the gasket in the deformed shape within the channel 26. This means may either be pressure against the channel 26 by the container bead 34 during the filling operation, or as later discussed, by sealing the deformed gasket 16 to the channel 24 through an adhesive, which is not shown.

Figure 9:
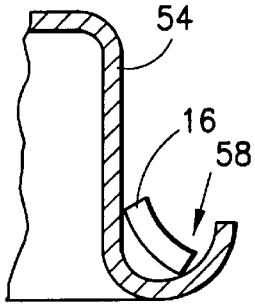

The present invention may be practiced with different types of mounting cups; and as a further example, FIGS. 8, 9, and 10, illustrate gasket 16 and an alternate type of mounting cup 50 on which the sleeve gasket of this invention may be positioned. Mounting cups 10 and 50 are very similar, and the two cups include corresponding parts. More specifically, mounting cup 50 includes a central body 52 having skirt 54 terminating in an outwardly rolled flange 56 that forms annular gasket receiving channel 58. The principal difference between cups 10 and 50 is that the channel 26 of the former cup has a relatively flat bottom surface, while channel 58 of cup 50 has a curved or rounded bottom surface.

Gasket 16 may be positioned on mounting cup 50 in a manner substantially identical to the way in which the gasket may be positioned on mounting cup 10. In particular, the gasket may be mounted on skirt 54 and then advanced, as viewed in FIGS. 9 and 10, into annular channel 58. Gasket 16 may be advanced by, for instance, the bead of container 34 or by a device such as shown in FIG. 11. As the gasket is advanced, flange 56 forces and guides the lower portion of gasket 16 radially outward, away from skirt 54, until the gasket is deformed 90° into the shape approximating a flat gasket, as shown in FIG. 10. The deformed gasket is maintained in this shape by either pressing the channel 58 and can rim 34 toward each other or by heat and/or adhesive means.

Figure 16A:
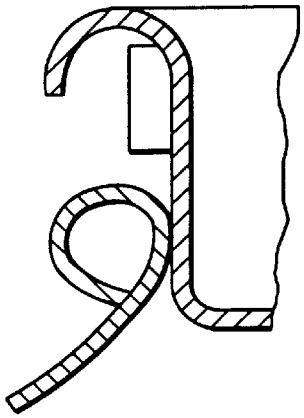
FIGS. 16A–16E a partial cross-sectional schematic view showing various stages of the container bead advancing the sleeve gasket of this invention onto the mounting cup.
Figure 16B:
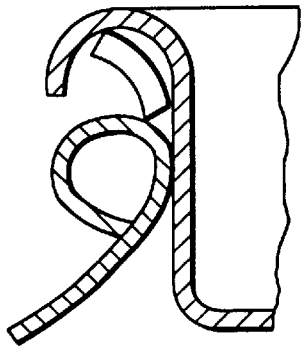
Figure 16C:
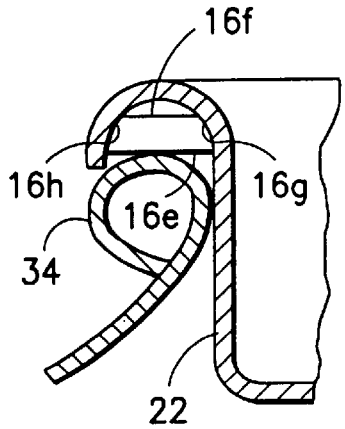
Figure 16D:
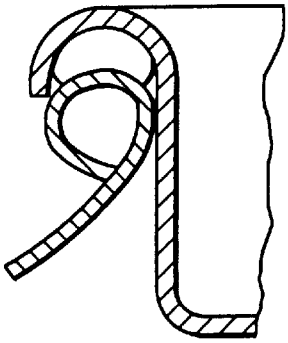
Figure 16E:
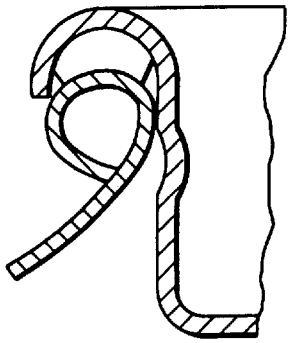

FIGS. 16A–E shows the bead 34 advancing toward the gasket 16 and urging the gasket 16 along the inner surface 23 of the skirt 22 until the gasket 16 is in the position shown in FIG. 16C. Further advancement of the bead 34 holds the gasket 16 against the inner surface 27 of the channel 26, as shown in FIG. 16D. Subsequently, the skirt 22 of the mounting cup 14 is radially outwardly clinched by means well known in the art to create a metal to metal contact between the container bead 34 and mounting cup 14 at the 4 o'clock position. The components of FIG. 16A have like parts in FIGS. 16B–E.

After gasket 16 is deformed into the desired shape in the gasket channel of the mounting cup—for instance, as shown in FIGS. 7 and 10—some means or process is employed to maintain or hold the gasket in that position. For example, an adhesive or bonding agent may be applied to the gasket or to the surface of the mounting cup channel to adhere the gasket to the metal channel. Alternatively, the gasket may be heated to relax stress that tends to cause the gasket to return to its original cylindrical shape. Any suitable adhesive or heating techniques may be used to hold the gasket in the desired shape and position.

Gasket 16 may be advanced on the skirt of a mounting cup and advanced into the annular channel thereof in one operation or in two separate steps. For instance, the gasket may be moved on the skirt of the mounting cup (as shown in FIGS. 5 and 8) at one location, and sold in this condition to a manufacturer of filled aerosol containers, who then advances the gasket into the annular channel of the mounting cup during filling, as shown in FIGS. 7 and 10 by urging the gasketed mounting cup of FIGS. 5 and 8 against the bead of the aerosol container.

Alternatively, a specific apparatus may be used to deform gasket 16 from the sleeve shape shown in FIGS. 5 and 8 to the cut gasket shape shown in FIGS. 7 and 10, and FIG. 11 is a schematic representation of one such apparatus 60. Generally, apparatus 60 includes a tubular guide bushing 62 forming a central through opening 64, and a tubular gasket engaging member 66 slidably disposed in opening 64 for upward and downward reciprocating movement therein. Member 66 includes an inside cylindrical surface 66*a* having a diameter equal to or slightly greater than the outside diameter of cup body 20.

Figure 12:
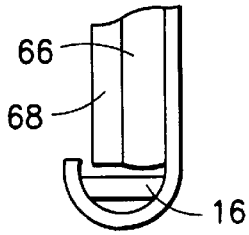
FIG. 12 is a partial cross-sectional schematic view showing the apparatus of FIG. 11 advancing the gasket to its position on the mounting cup prior to engagement of the mounting cup and the bead of the container.

In the operation of apparatus 60, mounting cup 14 is held below member 66 in any appropriate manner, with the sliding member substantially coaxially aligned with cup body 20 and with gasket 16 applied on this mounting cup generally in the position shown in FIGS. 5 and 11. With reference to FIGS. 11 and 12, member 66 is then slid downward, along the outside of cup body 20, and into engagement with the top edge of gasket 16. Member 66 is then slid further downward, forcing the gasket downward and outward along the bottom surface of channel 26, until the gasket deforms into the shape shown in FIG. 7. Simultaneously, member 68 is slid downward along the inside of guide bushing 62 to contact the top surface 16*e* at the same time as member 66. Pressure is applied by members 66 and 68 to force the gasket against the mounting cup annular channel.

Members 66 and 68 are then slid upward, off mounting cup 14, and mounting assembly 10 is then removed. Depending on the nature and size of the operation involved, apparatus 60 may be manually operated or automatically operated by appropriate means that, for the sake of simplicity, is not specifically illustrated. Also, as mentioned previously, after gasket 16 is deformed into the desired shape, a means or process may be used to maintain the gasket in that shape. This may be accomplished by heating the cup prior to pressing the gasket against the channel which will relax the stress present in the deformed gasket. Alternatively, or in conjunction with heating, adhesive applied to gasket surface 16*f* or to the surface of channel 26, or both, may be used to seal and hold the deformed gasket against the mounting cup channel until the valve is sealed to the can rim.

After gasket 16 is deformed into the desired cut gasket shape and valve mounting assembly 10 is moved onto container 12, assembly 10 may be clinched to the container 12. When this is done, gasket 16 is compressed and tightly held between the clinched cup 14 and the curl 34 of the container, forming the desired, highly effective seal therebetween.

Gasket 16 may be initially mounted on cup body 20 by any suitable way, and this may be done either manually or by automated means. For example, the gasket may be cut from a tube of suitable gasket material and then placed on the cup body 20. Alternatively, gasket 16 may be formed on cup body 20 by means of the processes and apparatus of the type disclosed in U.S. Pat. Nos. 4,546,525; 9,547,948; 4,559,198 and 5,213,231 in which a tube of the gasket material is mounted on the cup body, and then a portion of the tube is cut off, while on the cup body, to form the sleeve gasket on the mounting cup. The gasket is then pushed to the desired position on the mounting cup. The disclosures of the U.S. Patents listed in this paragraph are incorporated by reference herein.

Experimental results have shown that the performance of gaskets, constructed and employed in accordance with the present invention, are, generally, equivalent or superior to the performance of prior art gaskets. In particular, weight loss studies were conducted comparing the sleeve gasket of this invention with buna laid-in gasket and butyl rubber cut gasket in three different aerosol can sizes packed with three different formulations and stored upright at room temperature and at 45° C. The weight loss from each can, after one month of storage, was measured and extrapolated to one year's storage. These measurements show that the present invention produces excellent results, equal to or better than those prior art gaskets. The experimental results are shown in the graphs set forth in FIGS. 13–15. The lines in the graphs represent the connection of a series of data points.

Figure 13:
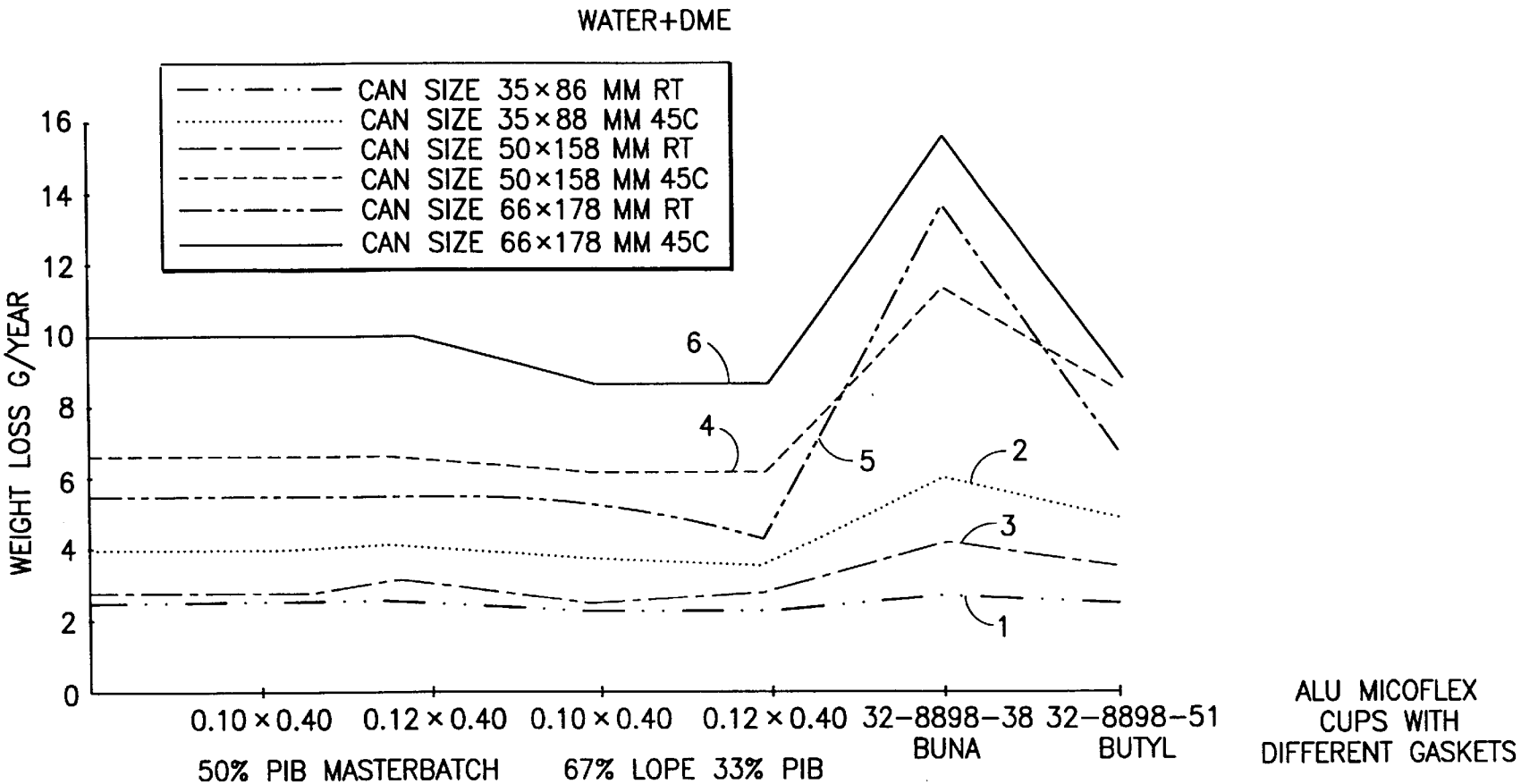
FIG. 13 is a graph showing the weight loss of various sized containers having the gasketed mounting of this invention at room temperature and 45° C. for the system water-dimethylether.
Figure 14:
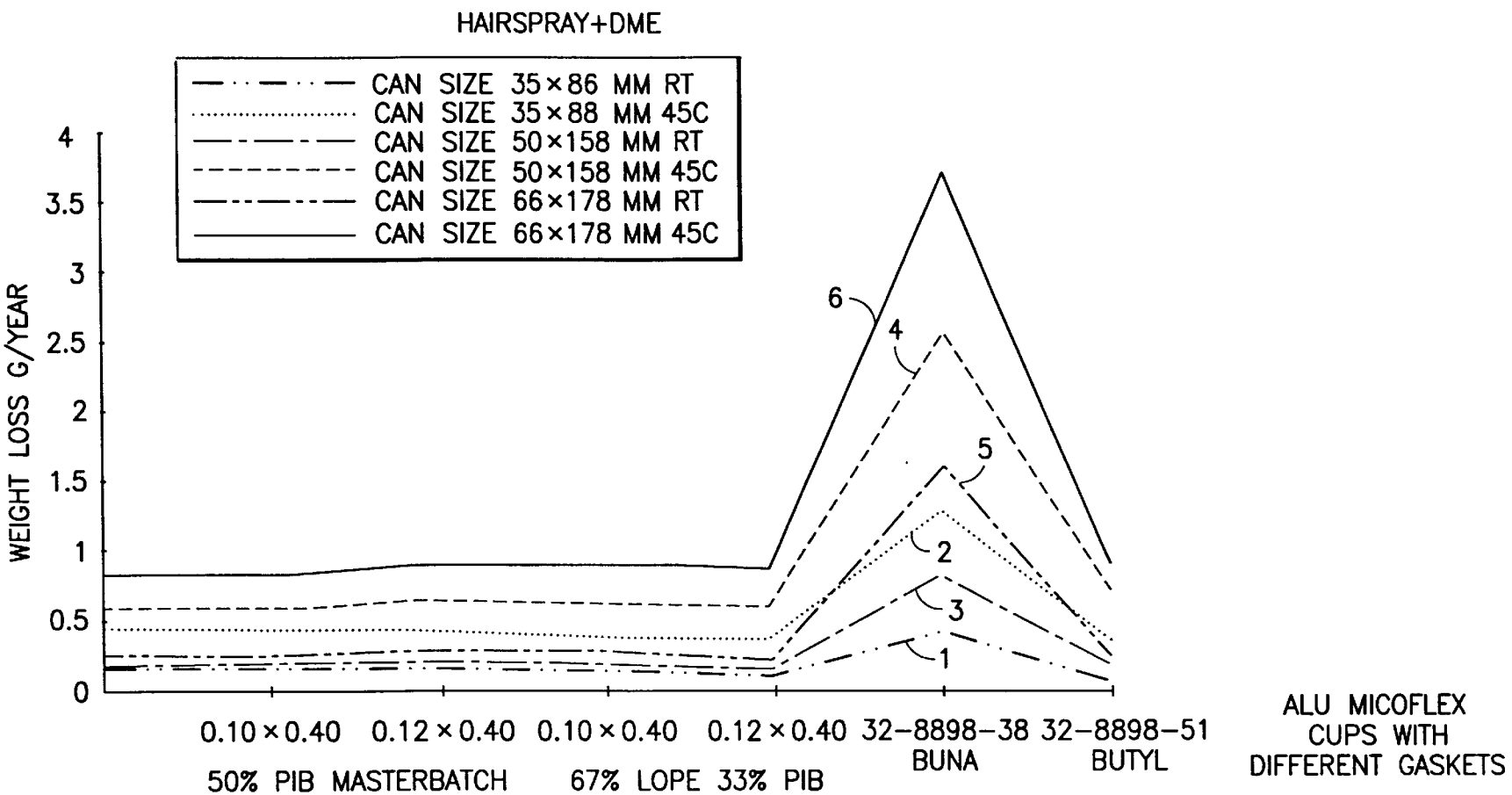
FIG. 14 is a graph similar to FIG. 13 but for the system hairspray-dimethylethane.
Figure 15:
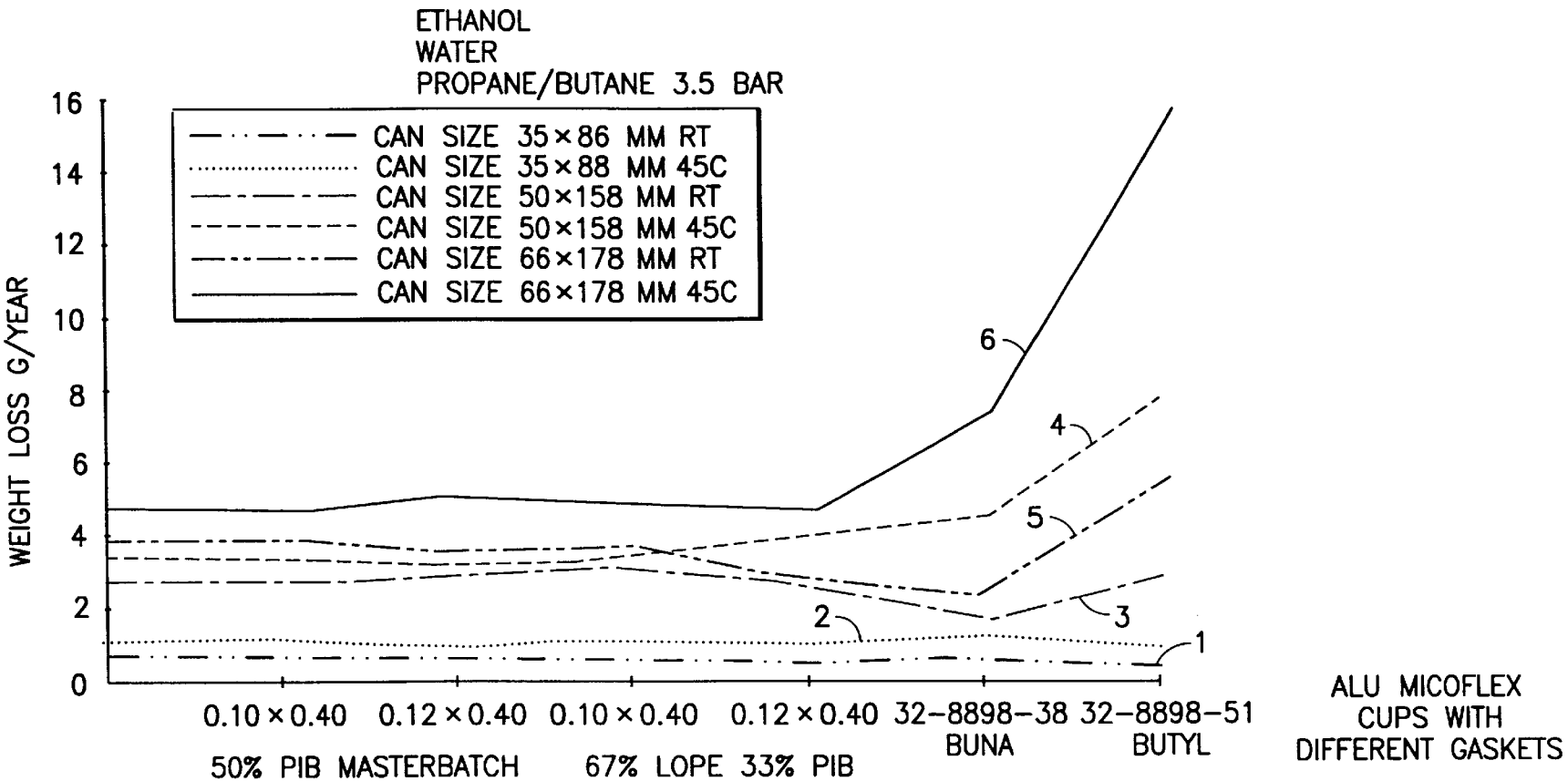
FIG. 15 is a graph similar to FIG. 13 but for the system ethanol-water-propane/butane (3.5 bar).

Inspection of the data set forth in FIGS. 13–15 indicates the sleeve is equivalent or superior to the Buna rubber laid-in gasket and the Butyl rubber cut gasket of the prior art.

The conversion of a sleeve type gasket, as initially mounted on the skirt of the mounting cup, to cut-type gasket after final positioning of the sleeve gasket into the channel portion of the mounting cup provides several improvements over prior art cut gasket systems. The use of an extruded sleeve type gasket avoids the necessary milling operation when using the cast flat or cut gasket. The sleeve-type gasket is assembled to the mounting cup from a continuous tube of the gasket material at the site of the gasket/mounting cup assembly and is an assembly procedure that is significantly less costly than assembling the cut gasket to the mounting cup. Finally, by dimensioning the sleeve gasket of this invention as set forth herein, the aerosol container filler may interchange the type of gasket, i.e., cut or sleeve, without dimensional adjustment of the crimping or filling parameters, thus effecting a cost benefit.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. An aerosol valve mounting assembly for an aerosol container comprising:

(a) a sleeve gasketed mounting cup having a central pedestal portion, a profile portion emerging radially outward from the central pedestal portion, a skirt portion extending substantially vertically from the radially outward terminus of the profile portion and a flange portion extending from the upper terminus of the skirt portion for receiving the bead of a container;

(b) said skirt portion having an outside diameter slightly less than the inside diameter of the bead of the container to which the mounting cup is to be clinched;

(c) said mounting cup having a sleeve gasket disposed on the skirt portion of the mounting cup, said sleeve gasket having an axial height and radial thickness from about 0.080 to 0.150 inches and from about 0.030 to 0/060 inches, respectively.

2. The valve mounting assembly of claim 1, wherein the axial height and radial thickness of the sleeve gasket is from about 0.090 to 0.190 inches and from about 0.035 to 0.055 inches, respectively.

3. The valve mounting of claim 2, wherein the axial height and radial thickness of the sleeve gasket is from about 0.100 to 0.130 and from about 0.400 to 0.050 inches, respectively.

4. The valve mounting assembly of claim 1, wherein a portion of the sleeve gasket is disposed in the flange portion of the mounting cup.

5. The valve mounting assembly of claim 4, wherein the axial height and radial thickness of the sleeve gasket is from about 0.080 to 0.150 inches and from about 0.030 to 0.060 inches, respectively.

6. The valve mounting assembly of claim 5, wherein the axial height and radial thickness of the sleeve gasket is from about 0.090 to 0.140 inches and from about 0.035 to 0.055 inches, respectively.

7. The valve mounting assembly of claim 6, wherein the axial height and radial thickness of the sleeve gasket is from about 0.100 to 0.130 inches and from about 0.040 to 0.050 inches, respectively.

* * * * *

UNITED STATES PATENT AND TRADEMARK OFFICE

CERTIFICATE OF CORRECTION

PATENT NO. : 6,341,711 B1
DATED : January 29, 2002
INVENTOR(S) : Robert R. Blake It is certified that error appears in the above-identified patent and that said Letters Patent is hereby corrected as shown below:

Column 9,
Line 23, change “0/060” to -- 0.060 --.

Column 10,
Line 3, change “0.190” to -- 0.140 --.
Line 7, change “0.400” to -- 0.040 --.

Signed and Sealed this

Eighteenth Day of May, 2004

JON W. DUDAS
*Acting Director of the United States Patent and Trademark Office*